US005325571A

United States Patent [19]

Bolliand

[11] Patent Number: 5,325,571

[45] Date of Patent: Jul. 5, 1994

[54] METHOD AND DEVICE FOR PRODUCING A SHAPED NON-WOVEN, NON-WOVEN OBTAINED AND USE THEREOF

[75] Inventor: Robert M. Bolliand, Ecully, France

[73] Assignee: Centre Technique Industriel dit: Institut Textile de France, France

[21] Appl. No.: 908,402

[22] Filed: Jul. 6, 1992

[30] Foreign Application Priority Data

Jul. 16, 1991 [FR] France ..... 91 09254

[51] Int. Cl.[5] ..... D04H 18/00; D01G 25/00

[52] U.S. Cl. ..... 28/112; 19/302

[58] Field of Search ..... 28/107, 110, 112; 19/157, 302

[56] References Cited

U.S. PATENT DOCUMENTS

| | | | |
|---|---|---|---|
| 2,434,887 | 6/1946 | Repass et al. | 19/161 |
| 4,404,717 | 9/1983 | Neubauer et al. | 28/112 X |
| 4,425,109 | 1/1984 | Konsti et al. | 19/302 X |
| 4,426,414 | 1/1984 | Wilkerson | 28/112 X |
| 4,481,696 | 11/1984 | Dilo | 19/302 X |
| 4,583,267 | 4/1986 | Fehrer | 19/302 X |
| 4,747,188 | 5/1988 | Cooper et al. | 19/302 X |
| 4,754,527 | 7/1988 | Gilhaus | 19/157 |
| 4,790,052 | 12/1988 | Olry | 28/110 |
| 4,889,063 | 12/1989 | Bompard et al. | 112/402 |
| 4,916,782 | 4/1990 | Caldwell | 28/112 X |
| 4,935,295 | 6/1990 | Serafini | 28/112 X |

FOREIGN PATENT DOCUMENTS

| | | |
|---|---|---|
| 0147297 | 7/1985 | European Pat. Off. . |
| 2437176 | 2/1976 | Fed. Rep. of Germany . |
| 2598723 | 11/1987 | France . |
| 0350584 | 1/1961 | Switzerland . |
| 2099365 | 12/1982 | United Kingdom . |

*Primary Examiner*—Clifford D. Crowder
*Assistant Examiner*—John J. Calvert
*Attorney, Agent, or Firm*—Ladas & Parry

[57] ABSTRACT

A method for producing a shaped non-woven comprises the steps of feeding fibers on a carding machine over a limited width, superposing on a receiving system the fibrous web leaving the carding machine and needling the superposed layers. The superposition is preferably obtained by winding over a cylindrical drain.

The shaped non-woven obtained has a thickness gradually decreasing towards its selvedges. The obtained strip has a cross-section of an asymmetrical shape by longitudinal cutting along the median axis and optionally two longitudinal cuttings on the selvedge side.

4 Claims, 1 Drawing Sheet

METHOD AND DEVICE FOR PRODUCING A SHAPED NON-WOVEN, NON-WOVEN OBTAINED AND USE THEREOF

FIELD OF THE INVENTION

The present invention relates to the production of a shaped non-woven, namely a non-woven having, in cross-section, a special shape with respect to the usual rectangular shape, It relates more specifically to a method for producing such a non-woven, to the non-woven obtained with such method, and also to a use thereof in the production of a gasket.

BACKGROUND OF THE INVENTION

To Applicant's knowledge, the only method for producing a shaped non-woven, namely a non-woven having, in cross-section, a shape which is not roughly rectangular, consists in making one or more slanted cuts in the non-woven, once the non-woven is produced. Although such cuts are feasible on non-wovens of a certain thickness and on the lateral faces thereof, they are nevertheless virtually impossible on the upper face. Therefore, it is difficult to obtain a non-woven having a cross-section which is not rectangular but for example trapezoidal.

It is the object of the present invention to propose a method for producing such a non-woven.

This method for producing a shaped non-woven comprises the step of feeding fibers to a carding machine, receiving the fibrous web leaving the carding machine and needling said web. The fibers are fed over a limited width of the carding machine and, moreover, the fibrous web leaving the carding machine is superposed into at least ten layers before needling.

Applicant has indeed found that when the fibers are not fed through the whole width of the carding machine, the edges of the obtained web are thinner than the mean thickness of said web. Said thickness difference is hardly noticeable on a unitary web leaving the carding machine. It is the merit of the invention to accentuate and draw advantage from this irregularity by controlling the feeding and by superposing unitary webs in the form of at least ten successive layers. In this way, the non-woven obtained has, in cross-section, a shape which is not rectangular. Some parts of the non-woven have a different thickness from the mean thickness of the web.

Relatively to the production of fibrous webs, document FR-A-2 598 723 describes a method and device for intermingling tapes of fibers notably at the level of carding machines. The method consists, after laying flat the fibrous tape, in intermingling the fibers of the tape by means of air jets so as to improve cohesion of the tape. To this effect, the apparatus comprises, in addition to the air injecting nozzles, a funnel of tape of which the edge has a cross-section reducing in the tape-conveying direction, and a device for guiding the fibers, which device is placed at the front of the funnel.

Another device is described in document DE-A-2 437 176, and is able to produce a fibrous web from a raw material constituted of fibers. In this device, the fibers, once introduced, are conveyed through a cavity under the action of an air stream, up to two perforated rollers of parallel axes. The fibers, having thus been sucked in, are applied against said rollers which rotate respectively in opposite directions. The fibers then pass between the two rollers where they mingle together in order to constitute the fibrous web. The orientation of the side walls of the cavity where the fibers pass through is adjustable, so as to obtain a fibrous web of given width.

It is not possible, with the two aforesaid known devices, to obtain a fibrous web with edges thinner than the mean thickness of the web. Therefore, the winding of the resulting web will not give a shaped non-woven as does the present invention.

A method and apparatus are also known from document EP 0 147 297, for producing structures formed by superposed layers of fibrous material, joined one to the other. To this effect, a strip of material is brought over a rotary mandrel, so as to be wound thereon it into successive overlapping spires. However, two successive spires are not superposed, as with the method according to the present invention. Moreover, the successive parts of the strip of material have generally been pre-needled for strengthening purposes, which makes them easier to handle.

Another method and device are also known from document CH-A-350 584 for directly winding on a winding machine, a strip of cotton leaving a carding machine. Said cotton strip has been strengthened prior to winding by passing between two rollers of a heated pre-shaping calendering machine. Admittedly, the cotton strip is wound in successive superposed layers, but as these layers have already been strengthened, the strip is not needled.

SUMMARY OF THE INVENTION

In a preferred embodiment of the invention, the superposition is achieved by winding the web leaving the carding machine over a cylindrical drum. In this case, the web, constituted in at least ten superposed layers, is cut crosswise before needling.

Understandably, the length of the shaped non-woven obtained in this way is, at the maximum, equal to the circumference of the cylindrical drum. This method is therefore particularly adapted for the production of shaped non-woven used in the construction of small-sized articles.

When the fiber feeding is set so as to occur on a median portion of the carding machine, the thickness variation of the cross-section corresponds to a bevelled cut of the lateral faces.

According to a variant of embodiment, the method according to the invention consists in feeding the carding machine in sequential manner over median portions narrowing from one sequence to another and, before needling, in superposing the layers obtained from the different sequences. It is then possible to obtain a shaped non-woven which has an upper face substantially triangular or in arc of circle.

For obtaining a non-woven with an asymmetrical-shaped cross-section, the method can include a longitudinal cutting operation, approximately along the middle axis and optionally along the two selvedges.

Another object of the invention is to provide a device for carrying out the aforesaid method. Said device comprises, in known manner, a carding machine equipped with a feeding system. Characteristically, the feeding system is equipped with control means for limiting the fiber feeding to a predetermined width of the carding machine; said device further comprises, at the outlet from the carding machine, a cylindrical drum for winding the web.

Preferably, the surface of the cylindrical drum is covered with a velvet coating, to allow the fibers to cling temporarily to the drum surface.

Yet another object of the invention is the shaped non-woven obtained with said method. It is in particular a non-woven strip of small width, between 10 and 20 cm, of which at least one lateral edge has a cross-section of approximately trapezoidal shape, the oblique face of which corresponds to the top of the strip.

Said non-woven strip is advantageously used in the production of gaskets.

BRIEF DESCRIPTION OF THE DRAWINGS

The invention will be more readily understood on reading the following description of one embodiment of the method for producing a strip of shaped non-woven of small width, given with reference to the accompanying drawing, in which:

DETAILED DESCRIPTION OF PREFERRED EMBODIMENT fig. 1 illustrates very diagrammatically, the path followed by the fibers 1, when these pass into the feeding system 2, into the carding machine proper 3 and into the receiving system 4.

Figure 1:
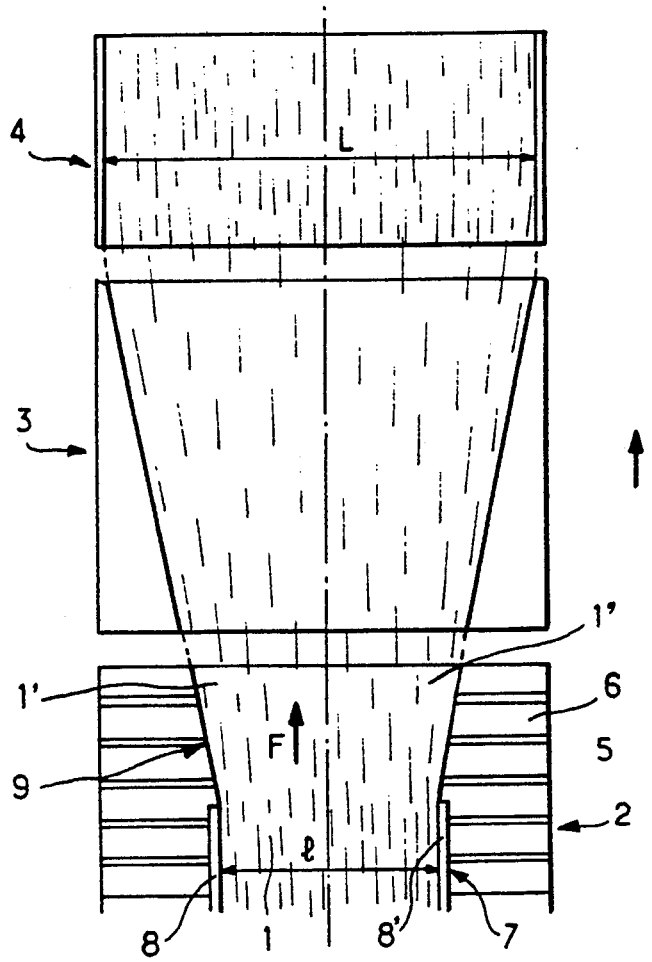
FIG. 1 is a diagrammatical plan view of the formation of a unitary web of fibers.
Figure 2:
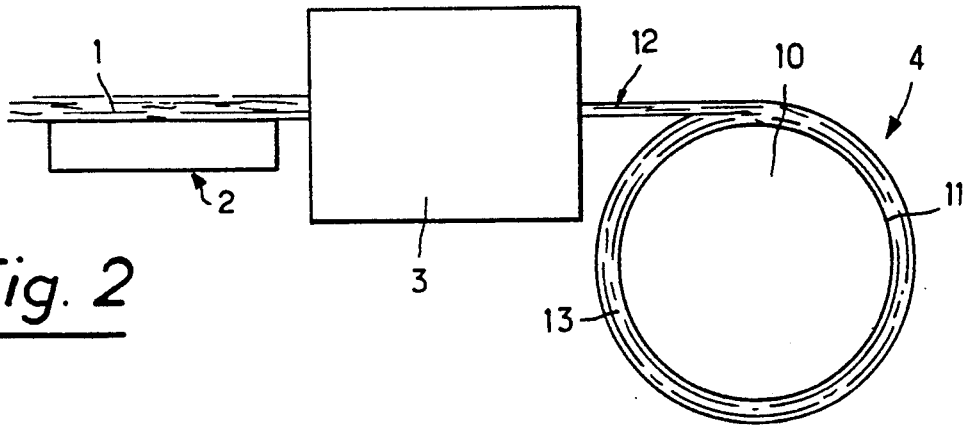
FIG. 2 is a diagram illustrating the formation of a shaped non-woven according to the invention.

The fibers 1 are deposited, by known means, possibly by hand in the case of a small production, on a feed lattice 5, constituted for example of transversal laths 6 driven forward in the form of a closed loop. A control device 7 makes it possible to determine the portion limited widthwise where the fibers 1 are fed with respect to the feeding lattices 5. Said device consists for example of two vertical members, mounted above the lattice and in parallel to the fibers moving direction, along arrow F, and completed with a transversal sliding device enabling the displacement of the two vertical members 8, 8' with respect to each other.

The fibers 1 occupy a width 1 between the two vertical members 8, 8'. Already when the fibers 1' situated on the lateral edges of the web move longitudinally on leaving the feeding system 2, and moreover when they pass over the cylinders of the carding machine, said fibers 1' also move crosswise, so that, overall, the web leaving the carding machine 3 has, on the receiving system 4, a width L which is greater than said width 1. As such increase of width is not due to a uniform transversal displacement of all the fibers 1, but instead to a transversal displacement of the fibers 1' situated close to the selvedges 9, a gradual decrease of the number of fibers is noted on these edges, hence a decrease of the thickness of the web.

This phenomenon could be explained by the fact that the fibers 1' along the selvedges 9 can gradually escape to occupy the free space where the selvedges 9 are relatively less clinging to the other fibers.

The web 12 of fibers of width L, leaving the carding machine, is received on a cylindrical drum 10, of which the outer surface is covered with a velvet 11. The fibers of the web 12 cling sufficiently to the velvet 11 for said web 12 to wind over the drum 10. Of course, the linear speed of drum 10 is equal to the discharge speed of the carding machine 3.

The web 12 leaving the carding machine 3 is wound over drum 10 in at least ten superposed layers, after what this stack of layers is cut crosswise. The obtained strip 13 has a total length which is equal to the circumference of the drum 10. It is detached from the velvet surface 11 and then needled.

Figure 3:
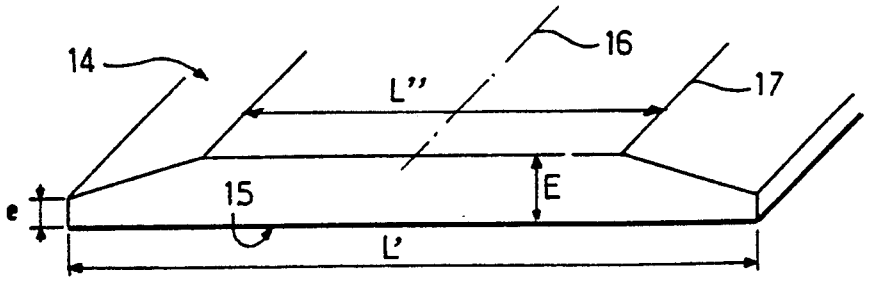
FIG. 3 is a perspective view of a truncated cone-shaped piece usable for producing a gasket.

The shaped non-woven 14, strengthened by the needling, has substantially the shape shown in FIG. 3, after longitudinal cuts have been made along the selvedges 9. In cross-section, the non-woven has a lower face 15 which is flat; this is the face which was in contact with the drum 10. Its total width L' corresponds to the width L at the outlet of the carding machine, after deduction of the lateral cuts.

The thickness E of the non-woven 14 in its median part 16 is substantially uniform over a middle zone of width L'', then, laterally, this thickness decreases to a value e. This gradual decreasing is shown in FIG. 3 as being linear. In actual fact, the lateral decrease of thickness takes on a form which varies with the fibers used, with the operational conditions, and with the tension exerted during the winding on the drum; of course, the discontinuity marked by line 17 in FIG. 3 is not visually noticeable.

The non-woven 14 can be cut along the median axis 16 and it can also be truncated to given lengths so that each element can be used in the production of gaskets. Said element of shaped non-woven is particularly advantageous for constituting, within the gasket, a stuffing pad of non-uniform thickness.

In one specific example of embodiment, the operational conditions were as follows: feeding of a small four-worker sampling wool card, over a width 1 of 100 mm, with 80 g of mineral fibers cut into lengths of 60 mm and having s count of 200 tex. The width of the web leaving the card was about 150 mm. The 80 g of fibers were wound in 35 layers on a drum of 1.25 m of circumference. After cutting, the strip was needled at the rate of 200 strokes/min., with a needle penetration of 10 mm and a density of 27 strokes/cm2. After lateral cutting the width L' was equal to 140 mm, L'' to 90 mm, E to 10.7 mm and e to 4.4 mm.

The example given hereinabove is just one illustration of what can obtained with the method according to the invention. Indeed, it is up to the man skilled in the art to set the conditions of limited width of the fiber feeding—whether this is median or off-centered—as well as the conditions of superposition of the unitary layers, as a function of the final shape of the non-woven that is sought.

For example, to obtain an effect of thickness decreasing laterally over a larger width, the feeding can be shifted in time, in several sequences, the feeding width 1 becoming narrower from one sequence to the other. Obviously, resulting from the superposition of the layers at each sequence, the non-woven will have a smaller width L'' for the same overall width L' in comparison with the example illustrated in FIG. 3. In this way, it is possible to obtain a substantially triangular shape and even in a shape of an arc.

The shaped non-woven according to the invention has substantially the same density of fibers throughout its volume.

What is claimed is:

1. A method for producing a shaped non-woven, comprising the following steps:

a) feeding fibers into carding machine, in sequential manner over median portions narrowing from one sequence to another;

b) superposing layers of a fibrous web leaving said carding machine on a receiving system;

c) feeding the fibrous web over a limited width 1 of the carding machine, the width L is smaller that the width L of the receiving system, and superposing the sequentially narrowing fibrous web leaving said machine in at least ten layers and needling the superposed layers.

2. The method of claim 1, wherein the superposition is achieved by winding the web leaving the carding machine over a cylindrical drum.

3. The method of claim l or 2, wherein the fiber feeding is controlled to reach a median portion of the carding machine.

4. The method of claim 1 for producing a non-woven having an asymmetrical shape in cross-section, wherein said method comprises a longitudinal cutting operation substantially along the median axis and optionally along the two selvedges.

* * * * *